US005328240A

United States Patent [19]

Neumuller

[11] Patent Number: 5,328,240

[45] Date of Patent: Jul. 12, 1994

[54] SUPPORT FOR A SEAT INCLUDING A PEDESTAL ADAPTED TO RECEIVE A VERTICALLY INCLINED COLUMN

[75] Inventor: Konrad Neumuller, Burgthann, Fed. Rep. of Germany

[73] Assignee: Sifa Sitzbabrik GmbH, Sulzbach-Rosenberg, Fed. Rep. of Germany

[21] Appl. No.: 892,206

[22] Filed: Jun. 2, 1992

[30] Foreign Application Priority Data

Jun. 1, 1991 [DE] Fed. Rep. of Germany ..... 4118013

[51] Int. Cl.[5] ..... A47C 3/00

[52] U.S. Cl. ..... 297/338; 297/195.1

[58] Field of Search ..... 297/313, 338, 337, 195; 248/133, 142, 629

[56] References Cited

U.S. PATENT DOCUMENTS

| | | | |
|---|---|---|---|
| 1,184,886 | 5/1916 | Spalding | 297/338 X |
| 1,711,526 | 5/1929 | Forsyth | 237/338 X |
| 1,826,643 | 10/1931 | Anderson | 297/338 X |
| 3,625,563 | 12/1971 | Dickinson | 297/338 X |
| 4,738,487 | 4/1988 | Shelinsky et al. . | |
| 4,793,654 | 12/1988 | Takafuji | 297/338 |

FOREIGN PATENT DOCUMENTS

| | | |
|---|---|---|
| 1270739 | 3/1986 | Canada . |
| 206309 | 10/1982 | Fed. Rep. of Germany . |
| 165413 | 8/1984 | Fed. Rep. of Germany . |
| 2349304 | 11/1977 | France . |
| 8802611 | 4/1988 | PCT Int'l Appl. . |

*Primary Examiner*—Laurie K. Cranmer
*Attorney, Agent, or Firm*—Brandt, Jr. George J.; Thomas R. Morrison

[57] ABSTRACT

A vertically adjustable seat with means to permit adjustment of the horizontal inclination of the seat and partial rotation thereof, consisting of a pedestal base, a support frame made of two tubings attached to it, as well as a seat supporting member fastened to the support frame and a seating unit affixed to this seat supporting member, in which arrangement the seat supporting member, along with the seating unit, is vertically adjustable along the support frame, and the seating unit is adjustable in inclination, in which arrangement the seating unit is fastened onto a seat supporting member and the seat supporting member is swivellably mounted between two forward projecting arms of a click-stop unit which is slidable along the support frame, said seat supporting member being capable of being locked into various positions, and in which arrangement the click-stop unit with detent latches is capable of being brought into engagement with detent holes in the support frame to effect adjustment of the height of the seat. Thus, vertical and horizontal adjustment of the seat is easily accomplished, and requires only one hand of the user. Partial rotation of the seat is also facilitated.

10 Claims, 3 Drawing Sheets

SUPPORT FOR A SEAT INCLUDING A PEDESTAL ADAPTED TO RECEIVE A VERTICALLY INCLINED COLUMN

This invention relates to a support for a seat, including a pedestal adapted to receive a vertically inclined column, the column being designed to support a bracket adapted, in turn, to support a seat number. The bracket is vertically adjustable along the column, and the seat member may be quickly adjusted in its horizontal inclination.

Various attempts have been made to provide an adjustable seat. German Patent 82 20 630 Ul, for example, discloses a support for a seat, consisting of a pedestal base, a support frame attached to it, as well as a seat supporting member fastened to the support frame and a seating unit affixed onto the seat supporting member. In the arrangement disclosed in this patent, the seat supporting member, along with the seating unit, is vertically adjustable along the support frame. The seat supporting member is fastened to the support frame by means of a clamp of the strap type. The disadvantage of this design is that the clamp is not secure enough, and that use of the clamp is awkward since it always requires the use of both hands to adjust the clamp, when adjusting the seat. In addition, no provision is made for any means of locking or adjusting the inclination of the seat itself. With respect to lateral rotation, as well, the seating unit of this German patent is completely rigid and uncomfortable.

A similar support for an adjustable seat is disclosed in German Patent 84 16 541 Ul in which there is also disclosed a seating unit which can only be adjusted vertically, and which requires the seat supporting member to be telescopically adjusted vertically within a support frame, and which is locked into place by means of an adjusting screw, or set screw. This design, moreover, results in the disadvantages of awkward operation, inadequate safety, and lack of comfort.

Another design which is well known in the prior art has a vertical adjustment of the seating unit by means of a pneumatic spring. However, this features makes the seat relatively expensive, and the design does not offer the comfort of a seat which may be adjusted in its horizontal inclination.

It is an object of the present invention to produce an adjustable seat which is simple in operation, provides safe and secure locking means for the vertical adjustment, and to provide simple and safe horizontal inclination adjustment means, without the use of any expensive components such as pneumatic springs.

The subject invention provides an adjustable support for a seat such that the seating unit is fastened onto a seat supporting member, the supporting member being mounted between two forwardly projecting arms of a unit that is slidably engaged of a generally vertical support column, the seat supporting member being capable of locking into place at pre-determined positions. A "click-stop" unit is embodied in the engagement and release mechanism, utilizing detent latches which engage into detent holes in the support column.

In one form of the invention the seat supporting member is U-shaped, with arms directed downwardly, and is mounted on a shaft affixed in the upper section of a "click-stop" unit, in which arrangement the shaft projects through slotted holes that are located in the arms of the seat supporting member, and which extend upwardly. This arrangement makes possible the movement of the seat supporting member along the length of the slotted holes. The lower sections of the arms of the seat supporting member are provided with adjusting notches which, in cooperation with the movement of the seat supporting member in the slotted holes, may be engaged with or disengaged from the detents located in the lower section of the arms of the "click-stop" unit.

The arms of the seat supporting member, in the embodiment under discussions, are provided with a curvilinear shape in the region of the adjusting notches, and the adjusting notches are located on both arms in pairs, in the same horizontal plane. Between the arms of the seat supporting member there is affixed a U-shaped handle, with arms projecting inwardly, this handle being swivellable around a shaft located between the arms of the seat supporting member, and below the first shaft which connects the seat supporting member and the "click-stop" unit. The arms of the handle are provided with a recess in the upper sections thereof, in the shape of a radial cam. The shaft which connects the seat supporting member and the "click-stop" unit is seated inside this recess, so that it provides a first position for the shaft within the radial cam, where it can be released, and a second position in the radial cam which may be entered by raising the handle, so that one pair of the adjusting notches will be engaged with the detent means on the seat support. In a second position, clear of the adjusting notches, and of the detent, the seat supporting member is freely swivellable between the arms of the "click-stop" unit.

The range within which the seat supporting member can be swivelled between the arms of the "click-stop" unit is delimited by means of detent stops affixed in front of and behind the adjusting notches of the arms of the seat supporting member and the detent.

The click-stop unit is comprised of an upper and a lower plate, these plates covering the arms of the unit, from above and below. The lower plate has guide holes which provide limited play for the support frame, and the upper plate has slotted holes for the support frame, so that inwardly pointing detent latches are affixed in the slotted holes in such a way that they project into detent holes located on the side of the support column that is opposite the seat supporting member whenever the click-stop unit is positioned in a first position adjacent to the rear side of the slotted holes, and so that the detent latches do not project into the slotted holes whenever the click-stop unit is positioned in a second position adjacent to the front side of the slotted holes. In the latter case the click-stop unit in the second position is freely slidably on the support column.

Between the arms of the click-stop unit and behind the arms of the seat supporting member there is affixed an interlocking shaft which projects outwardly and forwardly over the support frame through two horizontally positioned slotted holes in the arms of the click-stop unit. In the first position of the handle piece, the interlocking shaft is forced back in the slotted holes by the arms of the seat supporting member, and in this way the first position of the click-stop unit on the support column, and consequently the projection of the detent latches into the detent holes are lockably engaged. In the second position of the handle, the arms of the seat supporting member are sufficiently remote from the interlocking shaft that the shaft can occupy a forward position in the slotted holes, and as a result, by a swivelling movement of the click-stop unit, the detent latches on that unit can be taken out of engagement with the detent holes.

One advantage of the present invention is the provision of roller units with the interlocking shaft, adapted to fit the shape of the support column in the area where it is adjacent to the support frame, and, by means of springs affixed to the click-stop unit, to provide an initial tension to facilitate the locking of the detent latches into place in the detent holes.

As a result of the apparatus described above, an adjustable support for a seat is provided, which is adjustable by the use of one hand, in order to accomplish the raising of the handle, in order to bring about both vertical adjustment as well as an adjustment of the horizontal inclination of the seat. At the same time, the seat is securely locked into place in its position, and is additionally secured by means of the interlocking shaft.

The subject invention also permits easy partial horizontal rotation of the seat, through the provision of a ball bearing support provided between the seat and the seat support. The seat support member is provided, on its upper surface, with a central hole, and, equally spaced around the central hole, at least two arcuate grooves, adapted to receive ball bearings. Two cooperating arcuate grooves are provided in the undersurface of the seat, and the seat and the seat support are secured together by a bolt, washers, and securing nut, whereby the seat may be partially rotated on its support. A resilient connector is associated with the bolt, to effect return of the seat to its normal position. This feature, however, permits easy rotary movement of the seat, to provide additional comfort for the user, and to make it easier for the user of the seat to rise from a seated to a standing position. This last-named feature, of course, will find utility in other supports that do not have seating units which are adjustable vertically, or in horizontal inclination.

The invention will now be described in greater detail, with reference to the accompanying drawings in which.

Detailed reference will now be made to the drawings in which like reference numerals will identify like parts.

Figure 1:
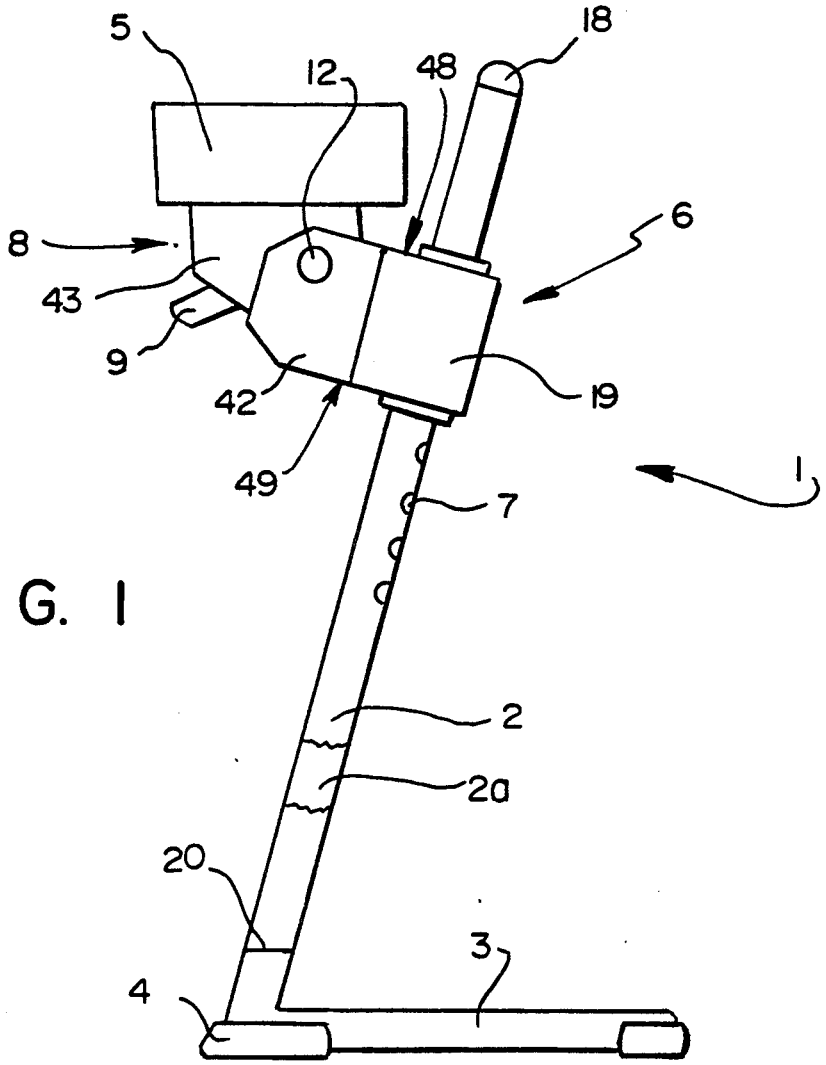
FIG. 1 is a side elevation of the adjustable seat in accordance with the invention.

Referring to FIG. 1, an adjustable seat is identified generally at 1, and comprises a pedestal base 3, having skid resistant feet 4, and a support column 2, extending upwardly from the pedestal 3, and inclining slightly rearwardly over the pedestal base 3. The inclination of column 2 provides stability for the seat 5. Support column 2 may be U-shaped, and be supported in recesses 20 provided in pedestal base 3. Support column 2 may be constructed as a unitary frame, with the pedestal base, or be comprised of a number of inter-fitting pieces.

Support frame 2 includes detent hole 7, in both of its sections, located on the rear side thereof, in even pairs, spaced-apart at regular intervals. A slidable click-stop unit 6 on support frame 2 is suspended and locked into place on detent holes 7, as will be described in more detail hereinafter. The click-stop unit 6 has an upper plate 48 and a lower plate 49, which are provided with holes to receive support column 2, and which partially cover a pair of arms 42 which project forwardly and extend beyond plates 48 and 49. Between arms 42 there is mounted a U-shaped seat supporting member 8, which is rotatable around shaft 12, on arms 43 which depend downwardly from seat 5. Shaft 12 thus connects click-stop unit 6 and the seat support member 8, and extends through the arms 42 and 43 of these units. On the upper surface of seat support member 8 is connected the seat 5. Between the arms 43 of the seat support member 8 a handle 9 extends forwardly.

Figure 2:
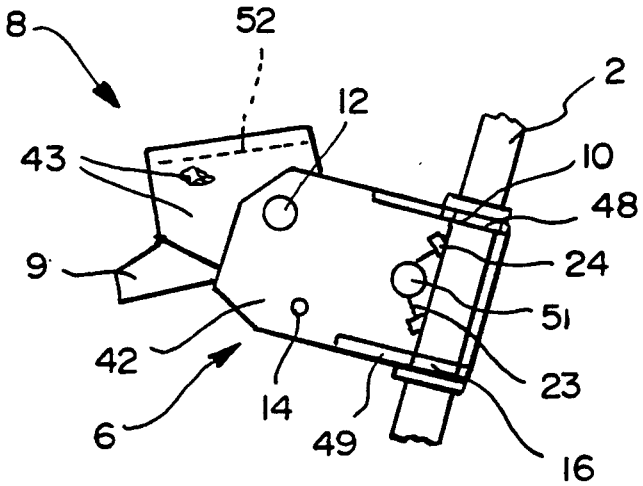
FIG. 2 is a side elevational view of a click-stop unit according to the invention, with its exterior casing removed.

Referring to FIG. 2, case 19 of the click-stop unit 6 (FIG. 1) and seat 5 are not illustrated. It will be seen that between plates 48 and 49 of the click-stop unit 6 a portion of support column 2 is illustrated. The support columns extend through slotted holes 10 in the upper plate 48 and the holes 16 in lower plate 49. On the tubular support columns 2 roller units are provided, these roller units being connected with an interlocking shaft which will be described in further detail hereinafter, the roller units being urged by means of springs 23, seated within openings 24 of plate 42 of click-stop unit 6, against the support column 2. In addition to the parts described in connection with FIG. 1, detent means 14 constructed in the form of a thin rod extending through arms 42 of the click-stop unit 8 are also illustrated in FIG. 2.

Figure 3:
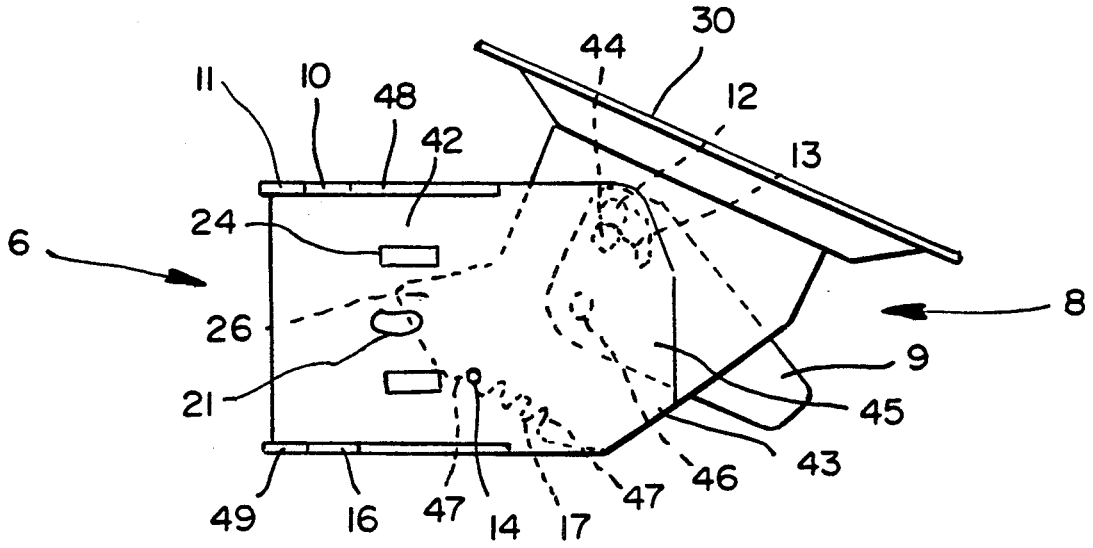
FIG. 3 is a side elevational showing, of the click-stop unit, the seat supporting member, and the handle.

Referring now to FIG. 3 the interaction of the parts of the click-stop unit 6 are illustrated. Seat support member 8, along with seat plate 30 and handle 9 are illustrated. The downwardly projecting arms 43 of the U-shaped seat support member 8 have adjusting notches 17, and, laterally next to the adjusting notches 17 are provided tangs 26 which serve both as detent stops 47, and as spacers. In the position illustrated in FIG. 3 the seat is in a fixed position, with one pair of the adjusting notches 17 of the arms 43 of the seat support member 8 located in pairs opposite one another, and resting on the rod 14, with rod 14 being seated in the arms 42 of the click-stop unit 6. As an alternative, the detent can also consist of simple projections or short bolts. In the position illustrated, the tangs 26 of the arms 43 of the seat supporting member in part project outwardly beyond horizontally slotted holes 21 located in the arms 42 of the click-stop unit 6, in which holes is guided an interlocking shaft, so as to be pressed backwardly, and thus prevent any dislocation of the click-stop unit 6 out of engagement with support column 2. In the position illustrated, the U-shaped handle 9 which is mounted to swivel on its downwardly directed arms 45 around shaft 46 mounted in the arms 43 of the seat support member 8, above the adjusting notches 17, the handle 9 being suspended in its most forwardly and downwardly direction, which is permitted by a recess located in its arms 45 above the shaft 46 and designed as a radial cam 13, for the shaft which connects the click-stop unit 6 and the seat support 8. The radial cam 13 runs from a point nearer the upper side of the handle piece 9 to a point that is farther away from this upper surface.

While the shaft 12 which connects the click-stop unit 6 and the seat support member 8 is immovably mounted in the arms 42 of the click-stop unit 6, the recess in the arms 43 of the seat supporting member, which holds this shaft 12, is designed in the shape of a slotted hole running diagonally upwardly. When the handle 9 is then lifted upwardly, and thus being partially rotated on its shaft 46, then shaft 12 connecting the click-stop unit 6 and the seat supporting member 8 move along the radial cam 13 in the arms 45 of the handle 9, by which action the seat support member 8 is forcibly lifted upwardly by one step, as is permitted by movement of shaft 12 in the slotted hole 44 in the seat support member arms. The raised seat support member 8 thus releases both the means of detent 14 and the interlocking shaft 22. At the same time, the seat supporting member 8 is raised only so far that the tangs 26 of the arms 43 of the seat support member 8 serve to limit the latter's swivelling range, e.g., when a stop 47 carried on tang 26 engages detent 14 (a like stop 47 is carried in front of adjustment notches 17). If the interlocking shaft 22 be released, i.e., by movement of the seat supporting arms 48 away from the shaft 22, it can be moved forwardly in the slotted hole 21, then the click-stop unit 6 can be tipped diagonally upwardly at the back, in slotted hole 10 in the upper plate 48, sufficiently far that the detent latches 11 come out of engagement with the support column 2, and the click-stop unit 6 can then be relocated on support column 2. If the handle 9 is released at that point, it will fall back under its own weight into the first locking position, provided that the detent latches 11 of click-stop unit 6 and the detent holes 7 of the support frame are in alignment.

Figure 4:
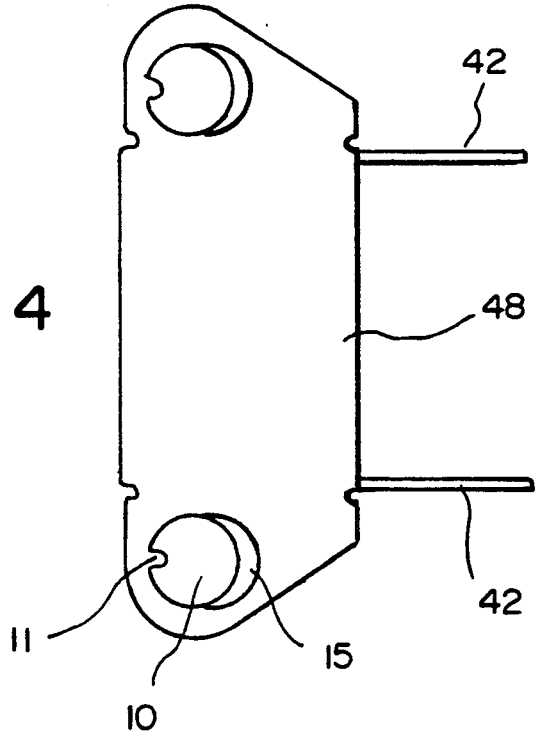
FIG. 4 is a top plan of the upper plate of the click-stop unit.

Referring to FIG. 4, a top plan view of upper plate 48 of click-stop unit 6 is illustrated, along with the forwardly projecting arms 42 and the slotted holes 10, along with the inwardly projecting detent latches 11. Inner walls 15 of slotted holes 10 in plate 48 are tapered slightly conically, so that they will lie flat against the tubing of support column 2 in two possible positions.

Figure 5:
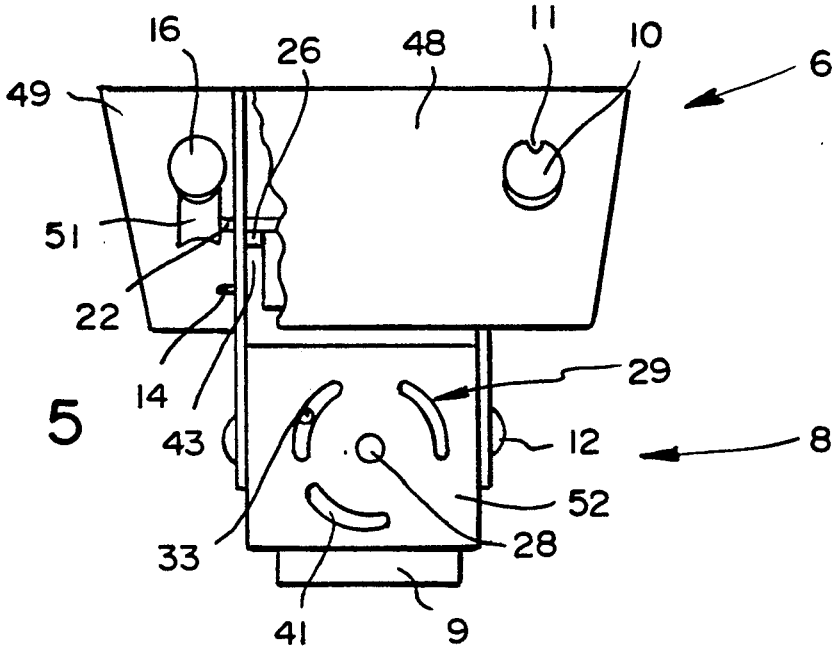
FIG. 5 is a top plan, partly in section, of the seat support member according to the invention, with the support frame removed.

Referring now to FIG. 5, top plan of the components of the click-stop unit 6 and the seat supporting member 8 are illustrated. The upper plate 48, along with the slotted holes 10 and the detent latches 11 have been in part cut away, in order to illustrate the lower plate 49 with hole 16 adapted to receive the tube of the support column 2. Seat support member 8 is mounted above the shaft 12 between the arms 42 of the click-stop unit 6. The cut away portion of FIG. 5 make it possible to see how the arms 43 of seat support member 8 are rearwardly directed and rest against interlocking shaft 22, through tangs 26, with shaft 22, in turn, being connected to roller unit 51, which in locked position rests on the tube of the support column 2. It will also be seen in FIG. 5 that detent 14, in the form of a thin rod, inclines laterally through arms 42 of the click-stop unit 6. The forward edge of handle 9 is also illustrated.

The upper surface of the seat support member 8 is provided with a hole, at its approximate centre, around which three inwardly curved grooves 29 are provided, at equally spaced intervals. Grooves 29 have deeper centers 41, and are shallowly troughed toward both ends. Grooves 29 serve as housings for ball bearings 33.

Figure 6:
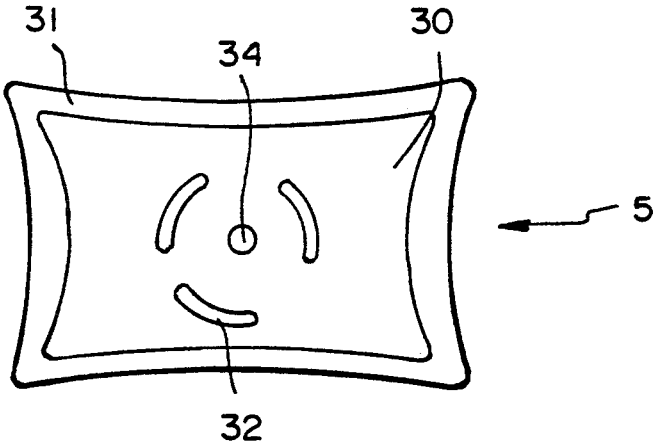
FIG. 6 is a bottom plan of the seating unit.

Cooperating with the upper surface of seat support member 8 is seat plate 30 of seating unit 5, illustrated in FIG. 6, to which is fastened padding 31. On the underside of seat plate 30 there is located a threaded rod 34 and grooves identical to those provided on seat support member 8, so as to permit easy partial rotation of seat 5.

Figure 7:
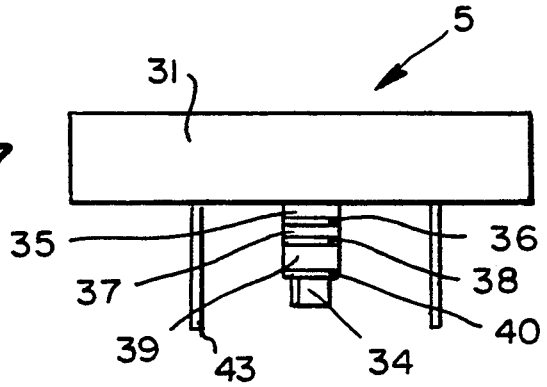
FIG. 7 is an elevation of the assembled seating unit and seat support member.

Referring to FIG. 7, seat 5 and its downwardly projecting rod 34 are supported by seat plate 8, with rod 34 being received in hole 28 thereof. After rod 34 is received through seat plate 30 and the upper surface 52 of seat bearing member 8, a washer 35, an axial bearing 36, a washer 37, a resilient element 38, such as, for example, a rubber ring, a further washer 39, and a nut 40 provide attachment means. Thus, if seating unit 5 is slightly rotated, ball bearings 33 will permit movement for a limited distance, within grooves 29 and 32. The resilient element 38 will permit this limited rotation, but will urge the seat to return to its normal position, when the seat is not longer in use. Thus, comfortable and easy rotation of the seat is provided, as desired, by the person using the seat. The foregoing is by way of example only and the invention should be limited only by the scope of the appended claims.

The embodiments of the invention in which an exclusive property or privilege is claimed are defined as follows:

1. Vertically adjustable seat with means to permit adjustment of the horizontal inclination of the seat and partial rotation thereof, comprising a pedestal base, a support column of two tubing pieces connected to the pedestal base, a seat supporting member fastened to the support column, and a seat unit fixed to the seat supporting member, the seat supporting member and the seat unit being vertically adjustably positionable along the support column, the seat unit being adjustable in inclination, characterized in that the seat unit (5) is fastened onto said seat supporting member (8), in that the seat supporting member (8) is swivellably mounted between two forward projecting arms (42) of a click-stop unit (6) being slidable along the support column (2) and lockable on the support column at selected positions thereon, and in that the click-stop unit (6) has detent latches (11) engagable with detent holes (7) on the support column (2), the seat supporting member (8) being U-shaped and having downward pointing arms (43), and in that the seat supporting member (8) is mounted on a shaft (12) fixed in an upper section of the click-stop unit between the arms (42) thereof, in which arrangement the shaft (12) projects through slotted holes (44) located in the arms (43) of the seat supporting member, the seat supporting member being movable along these slotted holes (44), and in that the arms (43) of the seat supporting member (8) have adjustment notches in lower sections thereof, which are capable of being engaged in and disengaged from a detent means (14) fixed in a lower section of the arms (42) of the click-stop unit (6) and in accordance with the movement of the seat supporting member (8) in the slotted holes (44).

2. Vertically adjustable seat with means to permit adjustment of the horizontal inclination of the seat and partial rotation thereof, according to claim 1, characterized in that the arms (43) of the seat supporting member are designed in a curvilinear shape in an area of the adjustment notches (17), and in that the adjustment notches (17) are fixed on both arms (43), the adjustment notches in one arm being paired with those in the other arm, and at the same level.

3. Vertically adjustable seat with means to permit adjustment of the horizontal inclination of the seat and partial rotation thereof, according to claim 2, characterized in that a U-shaped handle (9) with inward projecting arms (45) is fixed between the arms (43) of the seat supporting member (8), in that the handle (9) is swivellably mounted with a lower section of its arms (45) around a second shaft (46) fixed between the arms (43) of the seat supporting member (8) below the shaft (12)

which connects the seat supporting member (8) and the click-stop unit (6), and in that the arms (45) of the handle (9) are provided in an upper section thereof with a recess in the shape of a radial cam (13), and in that the shaft (12) connecting the seat supporting member (8) and the click-stop unit (6) is seated in this recess, and in that, by raising the handle (9), a first position of the shaft (12) in the radial cam (13) is left and a second position in the radial cam (13) is reached, and in that a pair of the adjustment notches (17) are in engagement with the detent means (14) in the first shaft position, and the adjustment notches (17) being out of engagement with the means of detent (14) in a second shaft position, in which arrangement the seat supporting member (8) is freely swivellable between the arms (42) of the click-stop unit (6) when the shaft is in the second position.

4. Vertically adjustable seat with means to permit adjustment of the horizontal inclination of the seat and partial rotation thereof, according to claim 3, characterized in that a range within which the seat supporting member (8) is swivellable between the arms (42) of the click-stop unit (6) is limited by detent stops (47) on the arms (43) of the seat supporting member (8) carried in front of and behind the adjusting notches and engagable with the detent means (14).

5. Vertically adjustable seat with means to permit adjustment of the horizontal inclination of the seat and partial rotation thereof, according to claim 4, characterized in that the click-stop unit (6) is constructed with an upper plate (48) and a lower plate (49), in which arrangement the plates (48,49) cover the arms of the unit at the top and the bottom, and in that the lower plate (49) has guide holes (50) 16 with minimum play for the support column (2), and in that the upper plate has slotted holes (10) for the support column (2), in which arrangement detent latches (11) pointing inward are fixed in these slotted holes (10) in such away that they project into detent holes (7) of the support column tubing pieces located on a side of the tubing pieces (2) which is opposite to the seat supporting member (8) whenever the click-stop unit (6) is positioned in a first position thereof adjacent to a rear side of the slotted holes (10), and in that the detent latches (11) are clear of the detent holes (7) when the click-stop unit (6) is positioned in a second position adjacent to a front side of the slotted holes (10), and in that, the click-stop (6) is in the second position on the support column it is freely slidable thereon.

6. Vertically adjustable seat with means to permit adjustment of the horizontal inclination of the seat and partial rotation thereof, according to claim 5, characterized in that between the arms (42) of the click-stop unit (6) and behind the arms (43) of the seat supporting member (8) there is fixed an interlocking shaft (22), and in that the interlocking shaft (22) projects outward and forward over the support column (2) through two horizontally located slotted holes (21) in the arms (42) of the click-stop unit (6), and in that the interlocking shaft (22) is pressed toward a back of the slotted holes (21) by means of the arms (43) of the seat supporting member (8) when the handle (9) is in a first position thereof, and thus the first position of the click-stop unit (6) on the support frame (2), and consequently the detent latches (11) are engaged in the detent holes (7), and locked into place, and in that, when the handle (9) is in a second position the arms (43) of the seat supporting member (8) are located remote from the interlocking shaft (22) such that this shaft can move to a forward position in the slotted holes (21) so that moving the click-stop unit (6) will cause the detent latches (11) to disengage from the detent holes (7).

7. Vertically adjustable seat with means to permit adjustment of the horizontal inclination of the seat and partial rotation thereof, according to claim 6, characterized in that the interlocking shaft (22) carries roller units (51) adapted to conformably engage the support column tubing pieces.

8. Vertically adjustable seat with means to permit adjustment of the horizontal inclination of the seat and partial rotation thereof, according to claim 6, characterized in that the interlocking shaft (22) is pre-tensioned by means of springs (23) fixed to the click-stop unit (6) in order to facilitate the locking of the detent latches (11) into position in the detent holes (7).

9. Vertically adjustable seat with means to permit adjustment of the horizontal inclination of the seat and partial rotation thereof, comprising a pedestal base, a support column of two tubing pieces connected to the pedestal base, a seat supporting member fastened to the support column, and a seat unit fixed to the seat supporting member, the seat supporting member and the seat unit being vertically adjustably positionable along the support column, the seat unit being adjustable in inclination, characterized in that the seat unit (5) is fastened onto said seat supporting member (8), in that the seat supporting member (8) is swivellably mounted between two forward projecting arms (42) of a click-stop unit (6) being slidable along the support column (2) and lockable on the support column at selected positions thereon, and in that the click-stop unit (6) has detent latches (11) engagable with detent holes (7) on the support column (2), the seat supporting member (8) having an upper surface (52), in that there is a hole (28) located at approximately the middle of the upper surface (52), in that around the hole (28) on the upper surface (52), placed at regular intervals apart, there are located at least two arcuate grooves (29), in that the grooves (29) have a deepening (41) in their centre sections, and from there they slope upward gradually on both sides, in that the seat unit (5) carries a seat plate (30) on its under side, in that from this seat plate (30) a threaded rod (34) extends downward through the hole (28) in the upper surface (52) of the seat supporting member (8), in that on the under side of the seat plate (30) there are likewise arcuate grooves (32) with deepenings and upward sloping ends fixed to correspond with the grooves (29) on the upper surface (52) of the seat supporting member (8), in that captive ball bearings (33) are placed in between the grooves (29) on the upper surface (52) of the seat supporting member (8) and the grooves (32) in the seat plate (30), and in that the threaded rod (34) beneath the upper surface (52) of the seat supporting member (8) extends downward through, an assembly of components including at least one washer (35), an axial ball bearing (36), another washer (37), a resilient element (38) and a further washer (39), said components being fastened in assembly by means of a nut (40).

10. Vertically adjustable seat with means to permit adjustment of the horizontal inclination of the seat and partial rotation thereof, comprising a pedestal base, a support column of two tubings connected to the pedestal base, a seat supporting member attached to the support column and a seat unit fixed onto this seat supporting member, characterized in that the seat supporting member (8) has an upper surface (52), in that approximately in the middle of the upper surface (52) there is located a hole (28), in that, in the upper surface (52), at regular intervals apart around the hole (28) there are fixed at least two arcuate grooves (29), in that the grooves (29) having a deepening (41) in their centre sections, and from there they gradually slope upward on both sides, in that the seat unit (5) carries a seat plate (30) on its under side, in that from the seat plate (30) a threaded rod (34) extends downward through the hole (28) in the upper surface (52) of the seat supporting member (8), in that on the under side of the seat plate (30) there are likewise fixed curvilinear grooves (32) with deepenings and upward sloping ends, to correspond to the grooves (29) in the upper surface (52) of the seat supporting member (8), in that captive ball bearings (33) are placed in between the grooves (29) in the upper surface (52) of the seat supporting member (8) and the grooves (32) in the seat plate (30), in that the threaded rod (34) underneath the upper surface (52) of the seat supporting member (8) extends downward through an assembly of components including at least one washer (35), an axial ball bearing (36), another washer (37), a resilient element (38) and a further washer, said components being fastened in assembly by means of a nut (40).

* * * * *